US005510050A

United States Patent [19]

Dunbar et al.

[11] Patent Number: 5,510,050

[45] Date of Patent: Apr. 23, 1996

[54] IMPROVED ACYL ISETHIONATE SKIN CLEANSING BAR CONTAINING LIQUID POLYOLS AND MAGNESIUM SOAP

[75] Inventors: James C. Dunbar, West Chester; Peter W. Beerse, Maineville; Eddie C. Walker, Cincinnati, all of Ohio

[73] Assignee: The Procter & Gamble Company, Cincinnati, Ohio

[21] Appl. No.: 300,880

[22] Filed: Sep. 6, 1994

Related U.S. Application Data

[63] Continuation of Ser. No. 148,804, Nov. 8, 1993, abandoned.

[51] Int. Cl.[6] ..... C11D 9/00; C11D 9/32; C11D 13/00

[52] U.S. Cl. ..... 252/108; 252/121; 252/122; 252/132; 252/134; 252/368

[58] Field of Search ..... 252/108, 121, 252/132, 368, 122, 134

[56] References Cited

U.S. PATENT DOCUMENTS

| | | | |
|---|---|---|---|
| 2,987,484 | 6/1961 | Lundberg et al. | 252/174 |
| 4,812,253 | 3/1989 | Small et al. | 252/132 |
| 4,820,447 | 4/1989 | Medcalf, Jr. et al. | 252/117 |
| 4,954,282 | 9/1990 | Rys et al. | 252/117 |
| 5,154,849 | 10/1992 | Visscher et al. | 252/174.17 |
| 5,204,014 | 4/1993 | Redd et al. | 252/117 |
| 5,211,870 | 5/1993 | Gilbert et al. | 252/121 |
| 5,264,144 | 11/1993 | Moroney et al. | 252/117 |
| 5,264,145 | 11/1993 | French et al. | 252/117 |
| 5,294,363 | 3/1994 | Schwartz et al. | 252/108 |
| 5,300,249 | 4/1994 | Schwartz et al. | 252/108 |
| 5,417,876 | 5/1995 | Tokosh et al. | 252/122 |

FOREIGN PATENT DOCUMENTS

| | | | |
|---|---|---|---|
| 203750 | 5/1986 | European Pat. Off. | A61K 7/50 |
| 1211197 | 12/1958 | France | C11D 16/45 |
| 845376 | 8/1960 | United Kingdom . | |

*Primary Examiner*—E. Rollins Cross
*Assistant Examiner*—Patricia Hailey
*Attorney, Agent, or Firm*—Tara M. Rosnell; Leonard Williamson

[57] ABSTRACT

The present invention encompasses a personal cleansing bar comprising from 10 parts to 70 parts by bar weight of sodium cocoyl isethionate (SCI), 4.5 parts to 50 parts magnesium soap and 4 parts to 15 parts liquid polyol, wherein said polyol has at least two alcohol groups attached to separate carbon atoms in the chain, and must be water soluble and liquid at room temperature. The bars of this invention are mild, lather better, and are easier to make than corresponding bars without liquid polyol.

13 Claims, No Drawings

IMPROVED ACYL ISETHIONATE SKIN CLEANSING BAR CONTAINING LIQUID POLYOLS AND MAGNESIUM SOAP

This is a continuation of application Ser. No. 08/148,804, filed on Nov. 8, 1993, abandoned.

TECHNICAL FIELD

The present invention relates to personal cleansing bars containing acyl isethionate.

BACKGROUND OF THE INVENTION

Sodium acyl isethionate combo bars are, per se, old in the art, e.g., mild sodium acyl isethionate synthetic surfactant based personal cleansing bars are also disclosed in U.S. Pat. No. 2,894,912, Jul. 1959, to Geitz and U.S. Pat. No. 4,954, 282, Rys, et al., Sep. 4, 1990.

This invention relates to improved mild sodium acyl isethionate based skin cleansing toilet bars. In other words, this invention relates to skin cleansing toilet bars comprising sodium acyl isethionate as a primary synthetic surfactant.

The cleansing of skin with surface-active cleansing preparations has become a focus of great interest. Many athletic and socially conscious people wash and exfoliate their skin with various surface-active preparations several times a day. Ideal skin cleansers should cleanse the skin gently, causing little or no irritation, without defatting and overdrying the skin or leaving it taut after frequent routine use. Most lathering soaps, liquids and bars included, fail in this respect.

Synthetic detergent bars, frequently referred to as "combo bars" and/or "syndet bars," are known and are becoming increasingly popular. However, widespread replacement of soap bars by syndet bars has not so far been possible for a variety of reasons, primarily the poor physical characteristics of syndet bars as compared to soap bars, e.g., off odors, poor processability, stickiness, brittleness, smear or bar messiness, lather quality or combinations thereof.

One object of the present invention is to deliver a bar formulation that is mild to the skin; another object is to deliver a bar with good lathering properties; and yet another is to have a formulation that is easily processable.

SUMMARY OF THE INVENTION

The present invention encompasses an improved acyl isethionate a personal cleansing bar comprising 10 parts-70 parts by bar weight sodium acyl (cocoyl) isethionate (SCI), 4.5–50 parts by bar weight of magnesium soap, and 4–15 parts by bar weight of liquid polyol, preferably glycerin. The SCI/magnesium soap/glycerin bar of this invention is very mild. It is also better lathering and/or is easier to make than SCI/magnesium soap bars without glycerin.

DETAILED DESCRIPTION OF THE INVENTION

More specifically, the SCI bar composition of this invention comprises the following components set out in Table A in full range, preferred and more preferred parts by weight of the bar.

TABLE A

| Bar Component in Parts | Full Range | Preferred | More Preferred |
|---|---|---|---|
| A. SCI | 10 to 70 | 15 to 60 | 20 to 50 |
| B. Na-Alkyl Glyceryl Ether Sulfonate or lathering cosurfactant | 0 to 50 | 5 to 30 | 10 to 25 |
| C. Na-soap | 0 to 20 | 1 to 15 | 2 to 12 |
| D. Mg-soap | 4.5 to 50 | 6 to 30 | 8 to 25 |
| E. Fatty Acid | 0 to 35 | 3 to 25 | 5 to 20 |
| F. Paraffin or wax | 0 to 30 | 3 to 25 | 5 to 23 |
| G. Glycerin or polyol | 4 to 15 | 5 to 14 | 6 to 13 |
| H. NaCl | 0 to 5 | 0.1 to 3 | 0.2 to 2 |
| I. Na2SO4 | 0 to 5 | 0.1 to 3 | 0.2 to 2 |
| J. Na-Isethionate | 0 to 15 | 1 to 10 | 2 to 8 |
| K. Water | 3 to 16 | 4 to 15 | 5 to 13 |
| L. Fragrance | 0 to 2 | 0.5 to 1.5 | 0.8 to 1.2 |

A = Sodium Cocoyl Isethionate (SCI). This ingredient is a key to the present invention. The preferred SCI is "STCI" herein defined as "sodium topped coconut isethionate which is further defined as SCI with alkyl carbon chains having: 0% to 4% of highly soluble acyl groups ($C_6$, $C_8$, $C_{10}$, $C_{18:1}$, and $C_{18:2}$); 45–65% $C_{12}$, and 30%–55% $C_{14}$, $C_{16}$, $C_{18}$. The terms SCI and STCI are used interchangeably herein unless otherwise specified.
B = Sodium Alkyl Glyceryl Ether Sulfonate (AGS) or cosurfactant. This ingredient can be included as a lather boosting synthetic surfactant. It is made from coconut fatty alcohols. Equivalent synthetic surfactants can be used.
C = Sodium Soap. This is a lather booster and processing aid.
D = Magnesium Soap. This ingredient is a key to the present invention. This is a non-soil load filler and processing aid.
E = Fatty Acid. This is a plasticizer.
F = Paraffin. This is a plasticizer.
G = Glycerin or polyol. This ingredient is key to the present invention. This is a binder, a process aid and/or lather booster.
H = Sodium Chloride. This provides bar firmness and improves bar smear.
I = Sodium sulfate. This provides bar firmness and improves bar smear.
J = Sodium Isethionate. This provides bar firmness and improves bar smear.
K = Water. This is a binder.
L = Fragrance. This is a binder and improves odor.

The bars of the present invention comprise three key ingredients: sodium acyl isethionate, magnesium soap and glycerin. Some high and low levels of these ingredients are set out below in Table B.

The term "Plasticizer" as used herein includes any material that is solid at room temperature, but is maleable at a temperature of about 35° C. to 46° C. (95° F. to 15° F.). This is the bar plodding processing temperature of the plasticizer. At least about 20 parts by bar weight is a plasticizer excluding any synthetic surfactant which can provide some plasticizer benefits.

The term "Binder" as used herein means any material that is by itself liquid, at room temperature and selected from water and liquid polyols.

TABLE B

| | Key Components Levels | | |
|---|---|---|---|
| Key Components | High | Low | Comments |
| SCI - 10 parts to 70 parts. | Brittleness 50 parts–70 parts | Lather 10 parts–20 parts | Assumes tradeoff with magnesium soap. |
| Magnesium Soap - 4.5 parts to 50 parts | Lather 40 parts–50 parts | Brittleness 4.5 parts–6 parts | |
| Glycerin - 4 parts to 15 parts (or polyol) | Stickiness, Smear 12 parts–15 parts | Processability, Lather 4 parts–6 parts | |

Referring to Table B, when the level of SCI surfactant is low, that is, from about 10 parts to about 20 parts by weight of the bar, the ratio of SCI and other lathering soaps and/or non-acyl isethionate surfactants described hereinafter is preferably from about 1:2 to about 1:8; preferably 1:3 to 1:6. This ratio is needed to provide acceptable bar lather.

Referring to Table B, when the level of SCI is high, that is, from about 50 parts to about 70 parts, the ratio of it to plasticizer (plastic materials defined hereinafter) is preferably from about 2.5:1 to about 3.5: 1. This ratio is needed to avoid unacceptable brittleness.

The formulation of synthetic detergent-based (syndet) bars is a delicate balancing act. There are numerous bar use properties to take into consideration: lather, messiness, economy, product pH, bar firmness, etc.

More specifically, the bars of the present invention can comprise: from about 10 parts to about 70 parts lathering mild synthetic surfactant; and wherein said lathering mild synthetic surfactant is acyl isethionate (SCI). Other preferred mild synthetic surfactants which can be used are selected from the group consisting of: $C_{12}$-$C_{14}$ alkyl glyceryl ether sulfonate, $C_{12}$-$C_{14}$ acyl sarcosinate, methyl acyl taurates, N-acyl glutamates, alkyl sulfosuccinates, alkyl phosphate esters, ethoxylated alkyl phosphate esters, trideceth sulfates, ethoxylated alkyl sulfates and alkyl amine oxides, betaines, sultaines, and mixtures thereof, and preferably as their sodium salts. At least about 10 parts of the bar is the mild lathering, sodium acyl isethionate (SCI).

The bars of the present invention can comprise: from 0 parts to 30 parts, preferably 3 parts to 25 parts, more preferably from about 5 parts to about 23 parts of wax, preferably paraffin, having a melting point of from about 130° F./54° C. to about 180° F./82° C.

The bars of the present invention can comprise: from about 0 to 35 parts; preferably 3 parts to 25 parts, more preferably from about 5 parts to about 20 parts free fatty acid.

The bars of the present invention can comprise: from 0 parts to about 20 parts, preferably 1 parts to 15 parts, more preferably from about 2 parts to about 12 parts, sodium soap.

The bars of the present invention can comprise: from about 0 parts to about 15 parts, preferably 1–10 parts, more preferably 2–8 parts sodium isethionate.

The bars of the present invention can comprise: from 0 parts to about 5 parts, preferably 0.1 to 3 parts, more preferably 0.2–2 parts; sodium chloride.

The bars of the present invention can comprise: from about 3 parts to 16 parts, preferably 4 parts to 15 parts, more preferably from about 5 parts to 13 parts water.

The bars of the present invention can comprise: from 0 parts to about 5 parts of cationic polymer.

The bars of the present invention can comprise: from 0 parts to about 2 parts perfume; preferably 0.5 parts to 1.5 parts, more preferably, 0.8 parts to 1.2 parts.

The bars of the present invention can comprise: from 4.5 parts to about 50 parts, preferably 6 parts to 30 parts and more preferably from about 8 parts to 25 parts magnesium soap.

The bars of the present invention can comprise: from 0–5 parts, preferably 0.1 to 3 parts; more preferably 0.2–2 parts, sodium sulfate.

The bars of the present invention can comprise: from 4 parts to about 15 parts, preferably 5 parts to 14 parts and more preferably from about 6 parts to 13 parts glycerin or polyol.

The bar has a pH of from about 4.0 to about 9.0, preferably 5 to 8, more preferably from about 6.5 to 7.5.

The bar contains by bar weight from 20 parts–60 parts; more preferably 25 parts–55 parts; most preferably 30 parts–50 parts of plastic material selected from the group consisting of: wax, free fatty acid, sodium soap, and magnesium soap, and mixtures thereof.

The percentages, ratios, and parts herein are on a total composition weight basis, unless otherwise specified. All levels and ranges herein are approximations, unless otherwise specified. Levels of ingredients are expressed herein on a bar "solids" basis, unless otherwise specified.

Mild Synthetic Surfactants Defined

It is noted that surfactant mildness can be measured by a skin barrier destruction test which is used to assess the irritancy potential of surfactants. In this test the milder the surfactant, the lesser the skin barrier is destroyed. Skin barrier destruction is measured by the relative amount of radio-labeled water ($^3H$-$H_2O$) which passes from the test solution through the skin epidermis into the physiological buffer contained in the diffusate chamber. This test is described by T. J. Franz in the *J. Invest. Dermatol.*, 1975, 64, pp. 190–195; and in U.S. Pat. No. 4,673,525, Small et al., issued Jun. 16, 1987, incorporated herein by reference, and which disclose a mild alkyl glyceryl ether sulfonate (AGS) suffactant based synbar comprising a "standard" alkyl glyceryl ether sulfonate mixture. (Barrier destruction testing surprisingly shows that the long chain alkyl sulfates are milder than standard AGS.)

The sarcosinates, and glyceryl ether sulfonates may be pure chain length variants or those derived from commercial oils such as coconut oil. Here, the lauryl chain length should preferably account for at least 20 parts to as much as 100 parts of the weight of the given mild surfactant.

A "high lathering surfactant" as defined herein, is one which lathers better than the long chain sodium cetearyl ($C_{16}$-$C_{18}$) alkyl sulfate.

A "mild sufactant" as defined herein is one that is milder than sodium dodecyl (laurel) sulfate.

Numerous examples of other surfactants in general are disclosed in the patents incorporated herein by reference. They include limited amounts of anionic acyl sarcosinates, methyl acyl taurates, N-acyl glutamates, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Included in the surfactants are the alkyl ether sulfates with 1 to 12 ethoxy groups, especially ammonium and sodium lauryl ether sulfates. Alkyl chains for these other surfactants are $C_8$-$C_{22}$, preferably $C_{10}$-$C_{18}$. Alkyl glycosides and methyl glucoside esters are preferred mild nonionics which may be mixed with other mild anionic or amphoteric surfactants in the compositions of this invention.

The bars of this invention can have from 0 to about 40 parts of low lathering, mild, essentially saturated long chain ($C_{15}$-$C_{22}$) alkyl synthetic surfactants selected from the group consisting of: alkyl sulfate, alkyl sarcosinate, alkyl glyceryl ether sulfonate, and mixtures thereof.

The bars of this invention can also have from 0 to about 10 parts of high lathering, non-mild surfactants and still maintain the preferred mildness requirement of the bar. Examples of these surfactants include linear alkyl benzene sulfonates and shorter chain or traditional (coconut) alkyl sulfates.

A preferred syndet bar can contain a mixture of sodium cocoyl isethionate (SCI) and sodium linear alkylbenzene sulfonate in a ratio of from about 35:1 to about 15:1, preferably from about 30:1 to about 20:1.

Plasticizers

The term "Plasticizer" as used herein means any material that is solid at room temperature, but is maleable at a temperature of about 35° C. to 46° C. (95° F. to 115° F.). This is the bar plodding processing temperature of the plasticizer. At least about 20 parts by bar weight is a plasticizer excluding any synthetic surfactant which can provide some plasticizer benefits.

The plasticizers may be comprised of solid aliphatic materials. e.g. fatty acids, fatty alcohols, paraffins, monoglycerides, diglycerides, triglycerides, alkali soaps, alkaline soaps, or high molecular weight (solid) hydrophilic materials, e.g. polyethylene glycols, polypropylene glycols, starches, sugars and/or mixtures thereof.

Preferred plasticizers of the present invention are: (1) fatty acid (2)sodium soap, and (3) wax, preferably paraffin wax.

The fatty acid material which is desirably incorporated into the present invention includes material ranging in hydrocarbon chain length of from about 10 to about 22, essentially saturated. These fatty acids can be highly purified individual chain lengths and/or crude mixtures such as those derived from fats and oils. The industry term "triple pressed stearic acid" comprises about 45 parts stearic and 55 parts palmitic acids. Thus, this is its meaning as used herein.

The composition may include soaps derived from hydrocarbon chain lengths of from about 10 to about 22 (including carboxyl carbon) and are preferably saturated. It is preferred that the soap be the sodium salt, but other soluble soap can be used. Potassium, ammonium, triethanolammonium, and mixtures thereof, are deemed acceptable. The soaps are preferably prepared by the in situ saponification or ion exchange with halide salt of the corresponding fatty acids, but they may also be introduced as preformed soaps. Either some or all of the soap is preferably precomplexed with cationic polymer, or polymers, when polymer is used.

"Insoluble" soaps, e.g., magnesium and zinc soaps, are not included in the level of "sodium soap" in the composition definition. However, insoluble soaps can act as non-lathering, non-soil-load diluents and processing aids.

The waxes are selected from the group consisting of beeswax, spermaceti, carnauba, baysberry, candelilla, montan, ozokerite, ceresin, paraffin, synthetic waxes such as Fisher-Tropsch waxes, microcrystalline wax, and mixtures thereof.

A highly preferred component of this invention is a wax, preferably paraffin wax having a melting point (M.P.) of from about 130° F. to about 180° F. (54°–82° C.), preferably from about 140° F. to about 165° F. (60°–74° C.), and most preferably from about 142° F. to about 160° F. (61°–71° C.). "High melt" paraffin is paraffin that has a melting point of about 150°–160° F. (66°–71 ° C.). "Low melt" paraffin is paraffin that has a melting point of about 130°–140° F. (54°–60° ). A preferred paraffin wax is a fully refined petroleum wax which is odorless and tasteless and meets FDA requirements for use as coatings for food and food packages. Such paraffins are readily available commercially. A very suitable paraffin can be obtained, for example, from The National Wax Co. under the trade name 6975.

As set out in Table A, herein, wax, preferably paraffin, is present in the bar in an amount ranging from about 3 parts to about 30 parts by weight. The wax ingredient is used in the product to impart skin mildness, plasticity, firmness, and processability. It also provides a glossy look and smooth feel to the bar.

The Binder

This invention can contain water and must contain a liquid water-soluble aliphatic polyol or polyethylene glycol or polypropylene glycol. The polyol may be saturated or contain ethylenic linkages; it must have at least two alcohol groups attached to separate carbon atoms in the chain, and must be water soluble and liquid at room temperature. If desired, the compound may have an alcohol group attached to each carbon atom in the chain. Among the compounds which are effective are ethylene glycol, propylene glycol, glycerin and mixtures thereof. A preferred polyol is glycerin, which is effective in amounts as low as 4 parts by weight, preferably 5 parts to about 14 parts; and more preferably from about 6 parts to about 13 parts.

Water-soluble polyethylene glycols, water-soluble polypropylene glycols useful in the present invention are those products produced by the condensation of ethylene glycol molecules or propylene glycol molecules to form high molecular weight ethers having terminal hydroxyl groups. The polyethylene glycol compounds may range from diethylene glycol to those having molecular weights as high as about 800, preferably, about 100 to 700, more preferably, 100 to 600. Normally, polyethylene glycols having molecular weights up to 800 are liquid and completely soluble in water. As the molecular weight of the polyethylene glycol increases beyond 800, they become solid and less water-soluble. Such solids may be used as plasticizers herein when maleable at 35° C.–46° C. The polypropylene glycol compounds useful in this invention may range from dipropylene glycol to polypropylene glycols having molecular weights of about 2000, preferably less than 1500, more preferably, less than 1000. These are normally liquid at room temperature and are readily soluble in water.

Other Ingredients

The syndet bar of this invention may comprise from 0 parts to about 5 parts, preferably from about 0.3 parts to about 1 parts, of a suitably fast hydrating cationic polymer. The polymers have molecular weights of from about 1,000 to about 5,000,000.

The cationic polymer (skin conditioning agent) is selected, e.g., from the group consisting of:

(I) cationic polysaccharides;

(II) cationic copolymers of saccharides and synthetic cationic monomers, and (III) synthetic polymers selected from the group consisting of:

(A) cationic polyalkylene imines;

(B) cationic ethoxy polyalkylene imines; and (C) cationic poly[N-[-3-(dimethylammonio)propyl]-N'-[3-(ethyleneoxyethylene dimethylammonio)propyl]urea dichloride].

Other ingredients of the present invention are selected for the various applications. E.g., perfumes can be used in formulating the skin cleansing products, generally at a level of from about 0.1 parts to about 1.5 parts of the composition. Vegetable oils, such as peanut and soybean oil, can be added at levels up to 10 parts, preferably 2–6 parts. Alcohols, hydrotropes, colorants, and fillers such as talc, clay, calcium carbonate, oils and dextrin can also be used at appropriate levels. Preservatives, e.g., trisodium etidronate and sodium ethylenediaminetetraacetate (EDTA), generally at a level of less than 1 parts of the composition, can be incorporated in the cleansing products to prevent color and odor degradation. Antibacterials can also be incorporated, usually at levels up to 1.5 parts. Salts, both organic and inorganic, can be incorporated. Examples include sodium chloride, sodium isethionate, sodium sulfate, and their equivalents.

Optional Adjunct Odor-Reducing or Odor-Controlling Materials

The compositions and articles of this invention can also contain an effective, i.e., odor-controlling, amount of various additional zeolite and non-zeolite odor-controlling materials to further expand their capacity for controlling odors, as well as the range of odor types being controlled. Such materials include, for example, cetyl pyridinium chloride, zinc chloride, EDTA, etidronate, BHT, and the like.

A preferred zeolite is substantially free of particles sized greater than 30 microns, and in fact is substantially free of particles sized over 15 microns for acceptable bar feel. "Substantially free" means that the larger particles are less than about 5 parts, preferably less than about 4 parts, more preferably less than about 3 parts, as measured by laser light scattering.

A preferred personal cleansing bar composition contains a zeolite at a level of from about 0.05 parts to about 5 parts by weight of the composition; preferably, the zeolite's $(SiO_2:Al_2O_3)Y$ molar ratio is from about 2:1 to about 50:1, said zeolite being in the protonic, sodium, potassium, ammonium, or alkylammonium form, and said composition contains 0 parts to about 0.5 parts perfume.

The following patents disclose or refer to ingredients and formulations which may be useful in the SCI bars of this invention, and are incorporated herein by reference:

| U.S. Pat. No. | Issue Date | Inventor(s) |
|---|---|---|
| 4,234,464 | 11/1980 | Morshauser |
| 4,061,602 | 12/1977 | Oberstar et al. |
| 4,472,297 | 9/1984 | Bolich et al. |
| 4,491,539 | 1/1985 | Hoskins et al. |
| 4,540,507 | 9/1985 | Grollier |
| 4,704,224 | 11/1987 | Saud |
| 4,812,253 | 3/1989 | Small et al. |
| 4,820,447 | 4/1989 | Medcalf et al. |
| 4,954,282 | 9/1990 | Rys et al. |
| 5,154,849 | 10/1992 | Visscher, et al. |

The SCI bars of this invention have a pH of from 4 to 9 in a 1 parts aqueous solution. The preferred pH is from about 5 to about 8, more preferably about about 6.5 to about 7.5.

A Method of Making SCI Bars
Crutching (A, B and C are Alternative Procedures)

A.

1. If used, add non-SCI synthetic surfactants (50°–75° C.); begin agitation.
2. If used, add NaCl, then $TiO_2$, then EDTA, then etidronate, and then zeolite, and bring crutcher mixture to 85° C. under low agitation.
3. Add premeasured caustic and $Mg(OH)_2$, if used, and continue to mix slowly.
4. Steam sparge to 85° C. before adding remaining ingredients.
5. Add fatty acid and mix for 5–10 minutes at 85° C.
6. Add the paraffin, SCI, SI and continue mixing slowly for approximately 15–30 minutes while maintaining the mix temperature at 85° C.
7. Add glycerin or liquid polyol slowly under constant agitation.

B.

1. Add paraffin, SCI, SI and begin agitating slowly while maintaining the temperature at 85° C.
2. If used, add non-SCI synthetic surfactant (50°–75° C.) and maintain slow agitation and recirculation.
3. If used, add NaCl, then $TiO_2$ then EDTA, then etidronate, and then zeolite, increasing the temperature in the 85° C. range under low agitation and steam sparging.
4. Add the premeasured caustic and $Mg(OH)_2$, if used, and continue to mix slowly.
5. Add the required fatty acid and mix for another 10 minutes at 85° C. Check for uniform consistency of the crutcher batch.
6. Add glycerin or liquid polyol slowly under constant agitation.

C.

1. If used, add non-SCI synthetic surfactants (50°–75° C.) to the crutcher and begin slow agitation.
2. Add the paraffin, SCI, sodium isethionate (SI) and continue to mix with agitation and begin recirculation.
3. If used, add NaCl, then $TiO_2$, then EDTA, then etidronate, and then zeolite, increasing the temperature to 85° C. while agitating and recirculating and steam sparging.
4. Add the premeasured caustic and and $Mg(OH)_2$, if used, and continue to mix slowly.
5. Add the required fatty acid and mix for another 10 minutes at 85° C. Check for uniform consistency of the crutcher batch and continue to mix until fluid and lump free.
6. Add glycerin or liquid polyol slowly under constant agitation.

Drying

The crutcher mix is dried and cooled using a combination flash chamber and chill roll or chill belt. The crutcher mix is first heated to approximately 265°–275° F. (130°–135° C.) by a heat exchanger and then flash dried in a chamber above the chill roll or chill belt. The chill belt or chill roll provides a uniform, thin cool (85°–95° F.; 29°–35° C.) product in flake or chip form. Typical moisture for the flake is from about 3 parts to about 15 parts, preferably from about 5 parts to about 10 parts. The way to regulate the moisture, in the order of preference, are: (1) increasing or decreasing steam pressure on the heat exchanger; (2) increasing or decreasing crutcher mix rate to the heat exchanger; and (3) increasing or decreasing crutcher mix temperature to the heat exchanger.

Amalgamating

The flakes are weighed and added to a batch amalgamator to obtain uniform flake size and a course mixture of additives that may be brought into the flake mixture (syndet or soap).

(Alternative Procedures):

A. Preweighed flakes may be amalgamated to uniform size and premeasured amounts of zeolite deodorizing powder and glycerin (if not added in the crutcher) are added into the base flakes and mixed for several minutes with no perfume being added.

B. Preweighed flakes may be amalgamated to uniform size and a premeasured amount of optional premeasured amount of perfume and glycerin (if not added in the crutcher). Continue amalgamating for at least one minute to thoroughly mix together the ingredients.

Milling

The 3-roll soap mills are set up with the first roll at ~120° F. (49° C.), the second roll at ~100° F. (38° C.), and the final roll at ~68° F. (20° C.). The material is passed through the mills several times to provide a homogeneous mixture of perfume and dried flakes. Typically the milled material has a temperature of 44° to 54° C.

Plodding and Stamping

The plodder is set up with the barrel temperature at about 11 5° F. (46° C.) and the nose temperature at 114°–122° F. (45°–50° C.). The ideal plodder is a dual stage plodder that allows use of a vacuum of about 15–25 inches (38–64 cm) of Hg. The plugs should be cut in 5 inch (13 cm) sections and stamped with a cold die block using die liquor such as alcohol, if appropriate.

Laboratory Assessment of Bar

The critical bar performance attributes are smear, lather, odor and processability.

Smear Test Procedure

Equipment:

1. #2-202C Fisher Brand Hexagonal Polystyrene weighing dishes (4"×3").
2. # 14-366A Fisher Brand Spatula.
3. Balance capable of weighing to two decimal points.
4. 120° F. (49° C.) Temperature Room.
5. Timer.

Test Method

1. Label and weigh the number of weighing dishes needed (two weighing dishes per sample, one labeled M for mush dish, one labeled S for soak dish).
2. Weigh the original bar and record the weight. Place bar in preweighed dish labeled S.
3. Add 30 mls room temperature city water to the dish containing the bar prototype (pour water down side of weighing dish). Add 30 mls room temperature city water to the dish containing the control bar. When placing the bars in the dish make sure the bars are not touching the sides of the dishes.
4. Allow bars to soak in weighing dishes at room temperature for 2 hours undisturbed.
5. After 2 hours of soaking, pick bar up carefully and allow to drain into the same dish for 15 seconds.
6. After 15 seconds, invert bar and place in preweighed dish labeled M.
7. Weigh soaked bar and record.
8. Scrape the wet surface or mush from the bar, with a spatula, into the same preweighed dish labeled M, weigh and record, this is the "wet smear" grade. Let the mush and soak water dry overnight, weigh and record. This is the "dry smear" grade. Best results for scraping are seen when the spatula is held loose in hand being careful not to gouge the bar or to scrape too deeply. When the surface of the bar no longer appears to look wet or shiny, scraping is completed. To eliminate variability of scraping from person to person, results from each test will be reported relative to the control placed in that test.

All series of testing should include control, and all samples should be run in duplicates. A maximum of 7 products (6 plus a control) can be tested at one time, and an interval of 10 minutes between every 4 samples should be allotted for the addition of water as to not allow any products a lag time for soaking longer than 2 hours.

Bar Soap Handwash Lather Volume Test

The handwash lather test is used to provide in-use lather volume measurements for the lather performance of skin cleansing bars. The test measures both the ultimate lather volume generated and the volume which is generated after a very short lathering period (to reflect lathering ease). The lather volumes are generated under soil-loaded conditions.

Synthetic soil is used for the soil-loaded lather volume test reported in the literature; see Small, et al., supra.

Grading Scale

Soil Loaded

7—Exceptional

6—Very much higher than target

5—Higher than target (See Example 4)

4—Target volume (See Example 3)

3—Slightly lower than target

2—Lower than target

Assessment of Processability: The Mill Test

Mill Test Procedure

1. A standard three-roll mill is employed with the take-up roll set at 120° F. (48° C.), the transfer roll at 110° F. (43° C.) and the discharge roll at 80° F. (26° C.).
2. Final flake thickness is about 0.010 inches.
3. After the third mill pass, the material is evaluated as described below.

Mill Grade Assessment (See Examples Herein)

| Grade | Product Flake Appearance Coming Off Mill |
|---|---|
| 10 | Like Standard Soap (50/50 T/C) |
| 9 | Non-Sticky; less than four compaction layers; no build-up. |
| 8 | Non-Sticky; less than four compaction layers; 0.010 in. (0.25 millimeters) build-up. |
| 7 | Slightly sticky; about eight compaction layers; 0.010 in.–0.016 in. build-up (See Example 2) |
| 6 | Slightly sticky; large chunks; bridging; >0.016" build-up. (See EE. 3) |
| 5 | More sticky; sheeting; >0.016" build-up. |
| 4 | Increasing stickiness; sheeting; bridging; dough-like; high build-up. |
| 1–3 | Extremely sticky; very difficult to process. |

Mill Force Assessment of Processability

As the material is removed from the discharge roll it impacts a sheet metal plate so that the 0.010 inch (0.25 millimeters) thick sheet of material gathers into compressed chunks. The force which the material exerts on the sheet metal plate is an indication of the cohesiveness and brittleness of the material. This force is recorded as the mill force gauge reading. A more cohesive, less brittle material is less processable on typical bar-making equipment. A large force gauge reading indicates a more cohesive, less brittle and therefore, a less processable formula.

EXAMPLES AND FORMULAS

The following examples and formulas are illustrative and are not intended to limit the scope of the invention. The methods of making milled bars are well known. All levels and ranges, temperatures, results, etc. used herein are approximations unless otherwise specified. Therefore, the percentages do not necessarily add up to 100 parts. All component levels are percentages based on weight.

Experimental Example 1 (E.E.1) vs. Example 2

These examples illustrate the ability to achieve better lather, and better processability via using 8 parts glycerin in a SCI/magnesium soap matrix (see Tables 1A –1C).

TABLE 1A

| Component | E.E. 1 | Ex. 2 |
|---|---|---|
| Na-Topped Cocoyl Isethionate | 21 | 20 |
| Na-Alkyl Glyceryl Ether Sulfonate (AGS) | 21 | 20 |
| Mg-soap** | 21 | 21 |
| Fatty Acid** | 1 | 1 |
| Glycerin | | 8 |
| Paraffin | 21 | 20 |
| NaCl | 0.5 | 0.5 |
| Na2SO4 | 1 | 1 |
| Na-Isethionate | 1 | 1 |
| Water | 7 | 5 |
| Fragrance | 1 | 1 |
| Miscellaneous* | Balance | Balance |
| Total | 100 | 100 |

*Miscellaneous includes unreacted feedstocks and products of secondary side reactions.

TABLE 1B

| Component<br>Chainlengths of SCI - Acyl Isethionate: | E.E. 1 | Ex. 2 |
|---|---|---|
| C8 | 0 | 0 |
| C10 | 0 | 0 |
| C12 | 60 | 60 |
| C14 | 23 | 23 |
| C16 | 10 | 10 |
| C18 | 7 | 7 |
| C18:1 | 1 | 1 |
| Total Isethionite | 100 | 100 |

**Soap and Fatty Acid Chainlengths:
Mg-soap and fatty acid chainlengths are representative of a blend of about 5 parts coconut, 10 parts lauric, 5 parts myristic and 80 parts triple pressed stearic acid or salts thereof.

The bar characteristics are set out in Table 1 c.

TABLE 1C

| | E.E. 1 | Ex. 2 |
|---|---|---|
| Processability | | |
| Mill Grade | 6.5 | 7 |
| Mill Force Gauge - lbs. force | 9 | 7 |
| Bar Performance - Smear | | |
| Wet Mush Smear | 1.1 | 1.2 |
| Dry Mush Smear | 1.5 | 1.7 |
| Bar Performance - Lather | | |
| Flash Soil Lather | 1.5 | 3.5 |
| Ultimate Soil Lather | 3 | 4 |

Experimental Example 1 (E.E. 1 ) is an acyl isethionate/magnesium soap bar that also contains sodium alkyl glyceryl ether sulfonate (AGS). AGS is known to make personal cleansing compositions difficult to process on milled bar systems. Referring to Table 1 C, E.E. 1 has a Mill Grade of 6.5 and Mill Force Gauge reading of 9. The lather grades of E.E. 1 are 1.5 and 3.

Example 2 is similar in composition to E.E. 1 but also contains 8 parts glycerin. Example 2 has better processability than E.E. 1 based on its larger Mill Grade of 7 and smaller Mill Force Gauge reading of 7. Example 2 also has better lather than E.E. 1 based on its greater lather grades of 3.5 and 4.

Example 2, based on its processability (7/7) and its outstanding lathers (3.5 and 4), is currently the best mode example.

Not shown is another preferred bar which is similar to Example 2 but with a 0.5 parts to 1.5 parts of polymeric skin feel aid.

Experimental Example 3 (E.E3) vs. Example 4

Tables 2A, 2B and 2C illustrate the ability to achieve better lather, and better processability via using 8 parts glycerin in an SCI/magnesium soap matrix.

TABLE 2A

| Component | E.E. 3 | Ex. 4 |
|---|---|---|
| Na-Topped Cocoyl Isethionate | 30 | 28 |
| Na-Alkyl Glyceryl Ether Sulfonate (AGS) | 16 | 15 |
| Na-soap** | 4 | 4 |
| Mg-soap** | 9 | 8 |
| Fatty Acid** | 11 | 9 |
| Glycerin | | 8 |
| Paraffin | 13 | 12 |
| NaCl | 0.5 | 0.5 |
| Na2SO4 | 1 | 1 |
| Na-Isethionate | 3 | 3 |
| Water | 6 | 6 |
| Fragrance | 1 | 1 |
| Miscellaneous* | Balance | Balance |
| Total | 100 | 100 |

*Miscellaneous includes unreacted feedstocks and products of secondary side reactions.

TABLE 2B

Acyl Isethionate Chainlengths (Same as Table 1B):

**Soap and Fatty Acid Chainlengths:
Na-soap, Mg-soap and fatty acid chainlengths are representative of a blend of about 5 parts coconut, 26 parts lauric, 6 parts myristic, and 63 parts triple pressed stearic acid or salts thereof.

TABLE 2C

| | E.E. 3 | Ex. 4 |
|---|---|---|
| Processability | | |
| Mill Grade | 6 | 6.5 |
| Mill Force Gauge - lbs. force | 19 | 5 |
| Bar Performance - Smear | | |
| Wet Mush Smear | 1.1 | 1.6 |
| Dry Mush Smear | NA | NA |
| Bar Performance - Lather | | |
| Flash Soil Lather | 2 | 4.5 |
| Ultimate Soil Lather | 4 | 5 |

NA - not available

Experimental Example 3 (E.E. 3) is an acyl isethionate/magnesium soap bar that also contains sodium alkyl glyceryl ether sulfonate (AGS). E.E. 3 has a Mill Grade of 6 and Mill Force Gauge reading of 19. The lather grades of E.E. 3 are 2 and 4.

Example 4 is similar in composition to E.E. 3 but also contains 8 parts glycerin. Example 4 has better processability than E.E. 3 based on its larger Mill Grade of 6.5 and smaller Mill Force Gauge reading of 5. Example 4 also has better lather than E.E. 3 based on its greater lather grades of 4.5 and 5.

Examples 5 and 6

These examples illustrate the improvement of processability by increasing the glycerin level from 8 parts to 12 parts in a SCI/magnesium soap matrix (see Tables 3A–3C).

TABLE 3A

| Component | Ex. 5 | Ex. 6 |
|---|---|---|
| Na-Topped Cocoyl Isethionate | 38 | 36 |
| Na-soap** | 4 | 4 |
| Mg-soap** | 20 | 19 |
| Glycerin | 8 | 12 |
| Paraffin | 10 | 10 |
| Na2SO4 | 0.5 | 0.5 |
| Na-Isethionate | 2 | 2 |
| Water | 12 | 12 |
| Fragrance | 1 | 1 |
| Miscellaneous* | Balance | Balance |
| Total Parts | 100 | 100 |

*Miscellaneous includes unreacted feedstocks and products of secondary side reactions.

TABLE 3B

Acyl Isethionate Chainlengths (See Table 1B):

**Soap and Fatty Acid Chainlengths:
Na-soap, Mg-soap and fatty acid chainlengths for Examples 5 and 6 are representative of a blend of about 8 parts coconut, 21 parts lauric, 9 parts myristic and 62 parts triple pressed stearic acid or salts thereof .

TABLE 3C

| | Ex. 5 | Ex. 6 |
|---|---|---|
| Processability | | |
| Mill Grade | 7 | 10 |
| Mill Force Gauge - lbs. force | 2.5 | 0 |
| Bar Performance - Lather | | |
| Flash Soil Lather | 3 | 2.5 |
| Ultimate Soil Lather | 3.5 | 3 |

Example 5 is an acyl isethionate/magnesium soap bar that contains 8 parts glycerin. Example 5 has a Mill Grade of 7 and Mill Force Gauge reading of 2.5. The lather grades of Example 5 are 3 and 3.5.

Example 6 is similar in composition to Example 6 but contains 12 parts glycerin. Example 4 has better processability than Example 5 based on its larger Mill Grade of 10 and smaller Mill Force Gauge reading of 0. Example 4 has lather grades of 2.5 and 3. The lower lathers for both these examples indicate a need for more lather-boosting surfactant.

Experimental Examples 7 and 8 (E.E. 7 and E.E. 8)

These examples illustrate the criticality of the magnesium soap level of this invention. The improvement of processability is not present upon the addition of glycerin when the magnesium soap level is at or below 4 parts (see Tables 4A–4C).

TABLE 4A

| Component | E.E. 7 | E.E. 8 |
|---|---|---|
| Na-Topped Cocoyl Isethionate | 21 | 20 |
| Na-Alkyl Glyceryl Ether Sulfonate (AGS) | 21 | 20 |
| Mg-soap** | 4 | 4 |
| Glycerin | | 8 |
| Paraffin | 38 | 39 |
| NaCl | 1 | 1 |
| Na2SO4 | 1 | 1 |
| Na-Isethionate | 1 | 1 |
| Water | 6 | 4 |
| Fragrance | 1 | 1 |
| Miscellaneous* | Balance | Balance |
| Total | 100 | 100 |

*Miscellaneous includes unreacted feedstocks and products of secondary side reactions.

TABLE 4B

Acyl Isethionate Chainlengths (Same as Table 1B):

Soap Fatty Acid Chainlengths:
Mg-soap fatty acid chainlengths used in E.E. 7 and 8, are representative of a blend of about 10 parts coconut, 53 parts lauric, 22 parts myristic, and 15 parts triple pressed stearic acid or salts thereof.

TABLE 4C

| | E.E. 7 | E.E. 8 |
|---|---|---|
| Processability | | |
| Mill Grade | 8 | 7 |
| Mill Force Gauge - lbs. force | 7 | 7 |
| Bar Performance - Smear | | |
| Wet Mush Smear | 0.6 | 0.8 |
| Dry Mush Smear | 0.8 | 1.2 |
| Bar Performance - Lather | | |
| Flash Soil Lather | 1.5 | 1.5 |
| Ultimate Soil Lather | 2.5 | 3 |

Experimental Example 7 (E.E. 7) is an acyl isethionate/magnesium soap bar. Note that the magnesium soap level is 4 parts. E.E. 7 has a Mill Grade of 8 and Mill Force Gauge reading of 7. The lather grades of E.E. 7 are 1.5/2.5.

Experimental Example 8 (E.E. 8) is similar in composition to E.E. 7 but also contains 8 parts glycerin. E.E. 8 has poorer processability than E.E. 7 based on its smaller Mill Grade of 7. This contrasts previous examples wherein the addition of glycerin improves processability. All previous examples that show the improvement in processability have greater than 4 parts magnesium soap.

Experimental Example 1 is a comparative to Example 2. Experimental Example 3 is comparative to Example 4. Examples 5 and 6 are alternative formulations of this invention. Experimental Examples 7 and 8 illustrate the criticality of the magnesium soap level. The bars containing glycerin are improvements over comparable bars made without glycerin. The glycerin improvements improved processability and/or improved lather.

What is claimed is:

1. A personal cleansing milled bar composition comprising by bar weight:

A. from about 10 parts to about 70 parts of sodium acyl isethionate;

B. from about 4.5 to about 50 parts magnesium soap;

C. from about 4 to about 15 parts glycerine; and

D. from about 3 to about 16 parts water.

2. A personal cleansing milled bar composition according to claim 1 which comprises from 20 to 60 parts of a plastic material selected from the group consisting of waxes, fatty acids, fatty alcohols, mono-, di- and triglycerides, alkali soaps, alkaline soaps, high molecular weight solid hydrophilic materials and mixtures thereof.

3. A personal cleansing milled bar composition according to claim 2 wherein said sodium acyl isethionate is sodium topped cocoyl isethionate wherein said sodium topped cocoyl isethionate has the following mixture of acyl groups: from about 45% to 65% C12; from about 30% to about 55% C14, C16. and C18; and from 0% to about 4% highly soluble acyl groups (C6, C8, C10 C18:1 and C18:2).

4. A personal cleansing milled bar composition according to claim 3 wherein the magnesium soap is present at a level ranging from about 6 to about 30 parts.

5. A personal cleansing milled bar composition according to claim 3 which further comprises from about 5 to about 30 parts of a lathering mild synthetic surfactant selected from the group consisting of methyl acyl taurates, N-acyl glutamates, alkyl sulfosuccinates, alkyl phosphate esters, ethoxylated alkyl phosphate esters, trideceth sulfates, ethoxylated alkyl sulfates and alkyl amine oxides, betaines, sultaines, C12-C14 alkyl glyceryl ether sulfonate, C12–C18 acyl sarcosinate, and mixtures thereof; wherein said sodium topped cocyl isethionate is present at a level ranging from about 10 to about 20 parts and wherein the ratio of said sodium topped cocyl isethionate to said lathering mild synthetic surfactant ranges from about 1:2 to about 1:8.

6. A personal cleansing milled bar composition according to claim 3 wherein said sodium topped cocyl isethionate is present at a level ranging from about 50 to about 70 parts and wherein the ratio of said sodium topped cocyl isethionate to said plastic material ranges from about 2.5:1 to about 3.5:1.

7. A personal cleansing milled bar composition according to claim 1 which further comprises from about 5 to about 30 parts of a lathering mild synthetic surfactant selected from the group consisting of methyl acyl taurates, N-acyl glutamates, alkyl sulfosuccinates, alkyl phosphate esters, ethoxylated alkyl phosphate esters, trideceth sulfates, ethoxylated alkyl sulfates and alkyl amine oxides, betaines, sultaines, C12-C14 alkyl glyceryl ether sulfonate, C12-C18 acyl sarcosinate, and mixtures thereof.

8. A personal cleansing milled bar composition according to claim 7 which further comprises from about 1 to about 15 parts of a sodium soap.

9. A personal cleansing milled bar composition according to claim 8 which further comprises from about 3 to about 25 parts of fatty acid.

10. A personal cleansing milled bar composition according to claim 9 which further comprise from about 3 to about 25 parts of a paraffin or wax.

11. A personal cleansing milled bar composition according to claim 10 wherein the sodium acyl isethionate is sodium topped cocoyl isethionate wherein said sodium topped cocoyl isethionate has the following mixture of acyl groups: from about 45% to 65% C12; from about 30% to about 55% C14, C16, and C18; and from 0% to about 4% highly soluble acyl groups (C6, C8, C10, C18:1 and C18:2).

12. A personal cleansing milled bar composition according to claim 4 wherein the magnesium soap is present at a level ranging from about 6 to about 30 parts.

13. A personal cleansing milled bar composition according to claim 12 wherein said sodium topped cocyl isethionate is present at a level ranging from about 20 to about 50 parts.

* * * * *